US010561885B1

(12) United States Patent
Lewis, Jr.

(10) Patent No.: US 10,561,885 B1
(45) Date of Patent: Feb. 18, 2020

(54) WEIGHTED EXERCISE BAG APPARATUS AND METHODS OF USE

(71) Applicant: Leo Nelson Lewis, Jr., Leesville, SC (US)

(72) Inventor: Leo Nelson Lewis, Jr., Leesville, SC (US)

( * ) Notice: Subject to any disclaimer, the term of this patent is extended or adjusted under 35 U.S.C. 154(b) by 0 days.

(21) Appl. No.: 16/253,463

(22) Filed: Jan. 22, 2019

Related U.S. Application Data

(60) Provisional application No. 62/620,194, filed on Jan. 22, 2018.

(51) Int. Cl.
*A63B 21/06* (2006.01)
*A63B 21/072* (2006.01)
*A63B 21/00* (2006.01)

(52) U.S. Cl.
CPC ..... *A63B 21/0602* (2013.01); *A63B 21/0603* (2013.01); *A63B 21/0604* (2013.01); *A63B 21/072* (2013.01); *A63B 21/4035* (2015.10)

(58) Field of Classification Search
CPC ..... A63B 21/0004; A63B 21/00043; A63B 21/00058; A63B 21/00061; A63B 21/00065; A63B 21/00069; A63B 21/00076; A63B 21/0601; A63B 21/0602; A63B 21/0603; A63B 21/0604; A63B 21/0605; A63B 21/0606; A63B 21/0607; A63B 21/065; A63B 21/068; A63B 21/072; A63B 21/0722; A63B 21/4023; A63B 21/4025; A63B 21/4027; A63B 21/4033; A63B 21/4034; A63B 21/4035; A63B 21/4039; A63B 21/4041; A63B 21/4043; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2209/00; A63B 2210/00; A63B 2210/50; A63B 2225/09; A63B 2225/093; A63B 2225/60; A63B 2225/62; A63B 2244/09; A63B 2244/10; A63B 2244/102;
(Continued)

(56) References Cited

U.S. PATENT DOCUMENTS 1,708,638 A * 4/1929 Smith ..... A63B 69/345 473/442
4,103,889 A * 8/1978 Lobur ..... A63B 69/201 273/DIG. 20

(Continued)

FOREIGN PATENT DOCUMENTS

WO WO-2010044651 A2 * 4/2010 ..... G10D 13/06

OTHER PUBLICATIONS

Meinl 2016 Cymbal Guide, pp. 56-58 (Year: 2016).*

(Continued)

*Primary Examiner* — Gary D Urbiel Goldner
(74) *Attorney, Agent, or Firm* — Nexsen Pruet, LLC; Todd A. Serbin

(57) ABSTRACT

An exercise bag apparatus, comprising: a cover comprising a first re-sealable opening; an inner sleeve placed within the cover when the exercise bag apparatus is fully assembled, the inner sleeve comprising a second re-sealable opening and an inner cavity configured for holding a weighty substance therein; and at least one user interface disposed on the cover.

7 Claims, 6 Drawing Sheets

(58) Field of Classification Search
CPC ..... A63B 2244/104; A63B 2244/106; A63B 2244/108
USPC ..... 482/83–90
See application file for complete search history.

(56) References Cited

U.S. PATENT DOCUMENTS

| | | | | | |
|---|---|---|---|---|---|
| 5,242,348 | A * | 9/1993 | Bates | A63B 21/0004 | 482/105 |
| 5,417,635 | A * | 5/1995 | Sell | A63B 21/0605 | 482/105 |
| 6,099,441 | A * | 8/2000 | Bonnet | A63B 21/072 | 482/106 |
| 6,106,443 | A * | 8/2000 | Kuo | A63B 69/34 | 482/83 |
| 6,827,674 | B1 * | 12/2004 | Ferry | A63B 69/201 | 482/83 |
| 8,276,351 | B1 * | 10/2012 | Henkin | A63B 21/00058 | 482/89 |
| 9,361,868 | B1 * | 6/2016 | Spriggel | G10D 13/06 | |
| 9,387,356 | B2 * | 7/2016 | Jaidar | A63B 15/00 | |
| 2002/0086776 | A1 * | 7/2002 | Fields | A63B 69/201 | 482/83 |
| 2002/0115538 | A1 * | 8/2002 | Wen | A63B 69/34 | 482/83 |
| 2004/0097348 | A1 * | 5/2004 | Laudenslager | A63B 69/201 | 482/86 |
| 2007/0099772 | A1 * | 5/2007 | Fu | A63B 69/004 | 482/83 |
| 2008/0188360 | A1 * | 8/2008 | Chu | A63B 69/004 | 482/83 |
| 2010/0022361 | A1 * | 1/2010 | Raines | A63B 21/06 | 482/93 |
| 2010/0048363 | A1 * | 2/2010 | Gilberti | A63B 21/0603 | 482/105 |
| 2011/0287904 | A1 * | 11/2011 | Morris | A63B 21/0602 | 482/93 |
| 2012/0058863 | A1 * | 3/2012 | Brizard | A63B 21/0004 | 482/93 |
| 2012/0149536 | A1 * | 6/2012 | Trimble | A63B 21/00065 | 482/93 |
| 2012/0157269 | A1 * | 6/2012 | Fu | A63B 69/20 | 482/86 |
| 2014/0226919 | A1 * | 8/2014 | Fu | A63B 69/20 | 383/3 |
| 2015/0273306 | A1 * | 10/2015 | Fu | A63B 69/201 | 482/87 |
| 2016/0129292 | A1 * | 5/2016 | Stroup | A63B 21/00065 | 482/93 |
| 2017/0050072 | A1 * | 2/2017 | Connelly | A63B 21/0605 | |
| 2018/0050253 | A1 * | 2/2018 | Magrino | A63B 69/20 | |
| 2018/0140897 | A1 * | 5/2018 | Hetrick | A63B 22/20 | |
| 2018/0154203 | A1 * | 6/2018 | Schromm | A45F 3/04 | |
| 2018/0247622 | A1 * | 8/2018 | Evans | G10G 7/005 | |
| 2018/0333603 | A1 * | 11/2018 | Peyton | A63B 21/072 | |

OTHER PUBLICATIONS

Webpage Kettlebell Sandbags from https://web.archive.org/web/20150824192729/https://bruteforcetraining.com/collections/kettlebell-sandbags-1 dated Aug. 24, 2015 Aug. 24, 2015.

* cited by examiner

WEIGHTED EXERCISE BAG APPARATUS AND METHODS OF USE

RELATED APPLICATION

This application claims the benefit of priority under 35 USC § 119(e) of U.S. Provisional Patent Application No. 62/620,194 filed Jan. 22, 2018, the contents of which is incorporated herein by reference in their entirety.

FIELD AND BACKGROUND OF THE INVENTION

The present invention, in some embodiments thereof, relates to human fitness and body building and, more particularly, but not exclusively, to a fitness and body building apparatus.

SUMMARY OF THE INVENTION

According to an aspect of some embodiments of the present invention there is provided an exercise bag apparatus, comprising: a cover comprising a re-sealable opening; an inner sleeve placed within the cover when the exercise bag apparatus is fully assembled comprising a re-sealable opening and an inner cavity configured for holding a weighty substance therein; and, at least one user interface disposed on the cover.

In an embodiment of the invention, the weighty substance includes at least one of particulate matter, liquid, solid matter, and at least one rock.

In an embodiment of the invention, the inner sleeve is at least one of air-tight and water-tight.

In an embodiment of the invention, the cover is filled with a weighty substance.

In an embodiment of the invention, the at least one user interface is at least one of a handle, a hook or a loop.

In an embodiment of the invention, the user interface is a mechanism selected from at least one of a handle, a hook, a trap, a band, a groove, a hole and a loop.

In an embodiment of the invention, the cover is constructed of a flexible material.

In an embodiment of the invention, the at least one user interface is reversibly attachable to the cover, such that the configuration and/or number of user interfaces is variable.

In an embodiment of the invention, the cover is shaped like a short cylinder when fully assembled.

In an embodiment of the invention, the exercise bag apparatus is approximately 10 inches to 30 inches in diameter.

In an embodiment of the invention, the exercise bag apparatus is approximately 2 inches to 12 inches in height.

According to a further aspect of some embodiments of the present invention there is provided a method of using an exercise bag apparatus, comprising: filling at least one of an inner sleeve or a cover, with at least one user interface disposed thereon, with a weighty substance; sealing at least one of the inner sleeve or the cover to prevent escape of the weighty substance; closing a re-sealable opening of the cover to prevent escape of the inner sleeve, if used; and, exercising using the exercise bag apparatus.

In an embodiment of the invention, the method further comprises placing the inner sleeve, if the inner sleeve is used, within the cover through the re-sealable opening prior to filling the inner sleeve.

In an embodiment of the invention, the method further comprises placing the inner sleeve, if the inner sleeve is used, within the cover through the re-sealable opening after filling the inner sleeve.

In an embodiment of the invention, the more than one weighty substance is filled into the at least one of an inner sleeve or a cover in combination so that the space within is more fully utilized.

In an embodiment of the invention, the method further comprises attaching the exercise bag apparatus using at least one of a handle, a hook, a trap, a band, a groove, a hole and a loop to another exercise implement comprising at least one of a weight bar, an exercise machine, a rack, a harness, a strap or a handle.

In an embodiment of the invention, the exercising comprises using the at least one user interface to use the exercise bag apparatus.

In an embodiment of the invention, the exercising comprises gripping the cover to use the exercise bag apparatus.

According to a further aspect of some embodiments of the present invention there is provided an exercise bag apparatus, comprising: a flexible cover comprising a re-sealable opening; and, at least one user interface disposed on the cover.

In an embodiment of the invention, the exercise bag apparatus further comprises an inner sleeve placed within the cover comprising a re-sealable opening and an inner cavity configured for holding a weighty substance therein Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings and photographic images "collectively, the "drawings"). With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
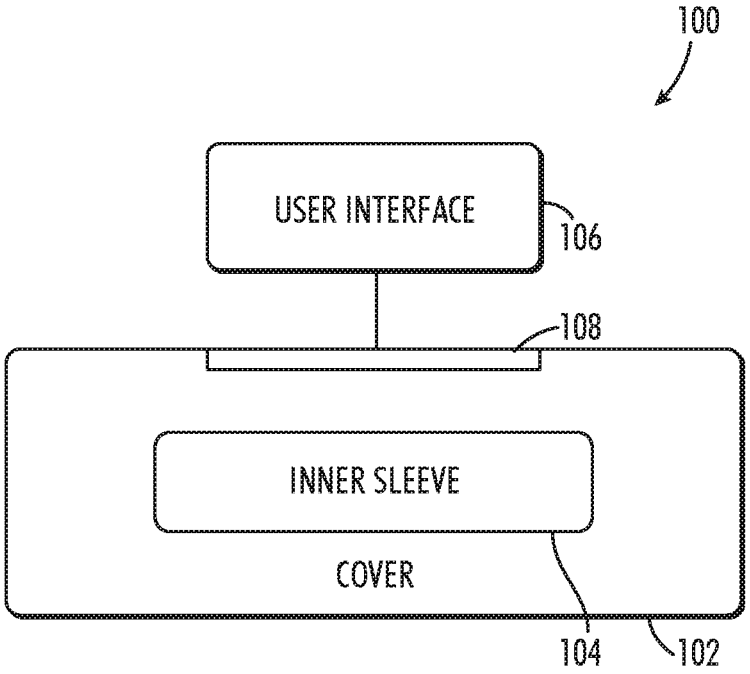
FIG. 1 is a block diagram of an exercise bag apparatus.

The present invention, in some embodiments thereof, relates to human fitness and body building and, more particularly, but not exclusively, to a fitness and body building apparatus.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways. Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

In an aspect of the invention, a bag-like apparatus is provided which can be filled, emptied and re-filled, as needed and with varying substances, in order to provide a weighted bag apparatus, optionally used for exercise purposes. It is conceived that the exercise bag apparatuses described herein can have any combination of user interfaces and/or attachment points, such as handles, hooks, loops, and the like, which can be utilized by a user to interact with the exercise bag apparatus either directly (e.g. by the user grasping the apparatus by hand) or indirectly (e.g. the bag apparatus is attached to something that the user interacts directly with).

FIG. 1 is a block diagram of an exercise bag apparatus 100, in accordance with an exemplary embodiment of the invention. In some embodiments, the exercise bag apparatus 100 is provided with an inner sleeve 104 which is adapted, for example by being hollow or bag-like having an inner cavity therein, to store therein a weighty substance which can impart weight to the exercise bag apparatus 100. Exemplary substances include, but are not limited to, particulate matter such as sand or gravel, liquids such as water, solid matter like concrete or metal objects, and/or at least one rock. Optionally, more than one weighty substance is stored in the inner sleeve 104 simultaneously, for example sand in combination with gravel so that the space within the inner sleeve 104 is more fully utilized. The inner sleeve 104 is constructed of a durable and optionally air-tight and/or water-tight material and is provided with a re-sealable opening, optionally air-tight and/or water-tight, for filling and emptying the at least one substance in the inner sleeve 104. Optionally, the apparatus 100 does not include an inner sleeve 104 and the at least one weighty substance is filled directly into the cover 104. Optionally, the inner sleeve 104 and the cover are filled with a weighty substance, which may or may not be the same weighty substance.

In an embodiment of the invention, the inner sleeve 104 is disposed within a cover 102 when the exercise bag apparatus 100 is fully assembled. As described elsewhere herein, the exercise bag apparatus 100 becomes a weighted exercise bag apparatus when the inner sleeve 104 is filled with a substance and then the inner sleeve 104 is placed inside the cover 102 through a re-sealable opening 108. Optionally, the inner sleeve 104 is at least partially filled, possibly entirely filled, after being placed into the cover 102. Cover 102 is configured with at least one user interface 106 or attachment point, such as a handle, a hook or a loop, to help a user of the exercise bag apparatus 100 interact with it. Optionally, the user interface 106 is a mechanism (e.g. strap, hook, band, loop, groove, hole) for attaching the exercise bag apparatus 100 to another exercise implement, for example a weight bar, exercise machine, rack, harness, strap and/or handle. In an embodiment of the invention, the cover 102 is constructed of a flexible, tough and/or durable material which is also not rigid. For example, the cover 102 is constructed of a para-aramid material like Kevlar® and/or an aramid material like Nomex®, flexible but strong materials which could be grasped/gripped by a user even without the use of a separate user interface 106. In an embodiment of the invention, the cover 102 is manufactured to exhibit a pre-determined shape, for example loosely pancake-shaped (i.e. shaped like a fat manhole or a short cylinder), such as shown in FIGS. 2-5. It should be understood, however, that the cover 102 could exhibit virtually any shape. Optionally, at least one user interface 106 is reversibly attachable (can be repetitively and conveniently attached to and removed from, for example using hook and pile fasteners, clips, snaps, and/or the like) to the cover 102, such that the configuration and/or number of user interfaces 106 is adjustable/variable.

Figure 2:
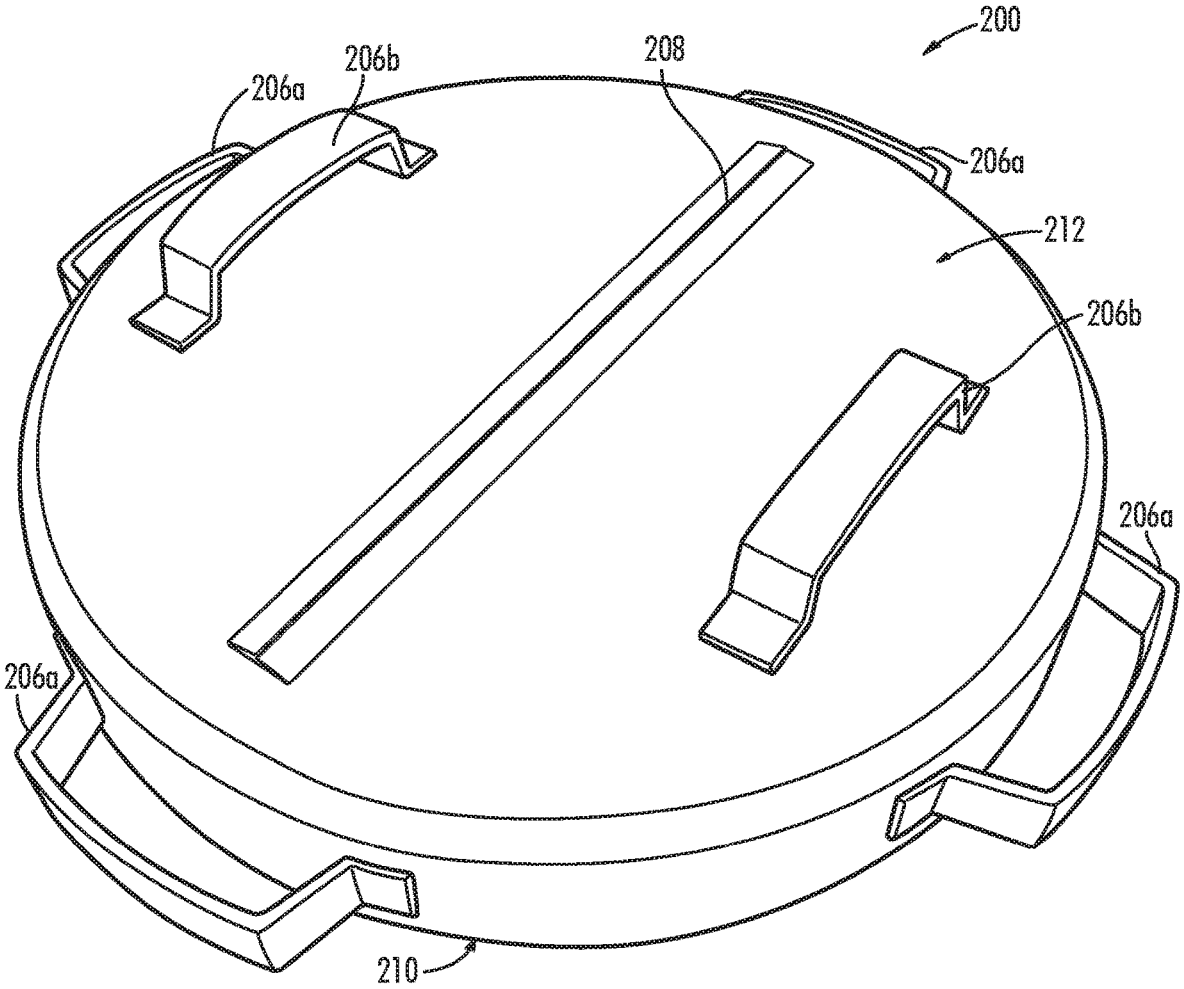
FIG. 2 is a perspective view of an exercise bag apparatus.
Figure 3:
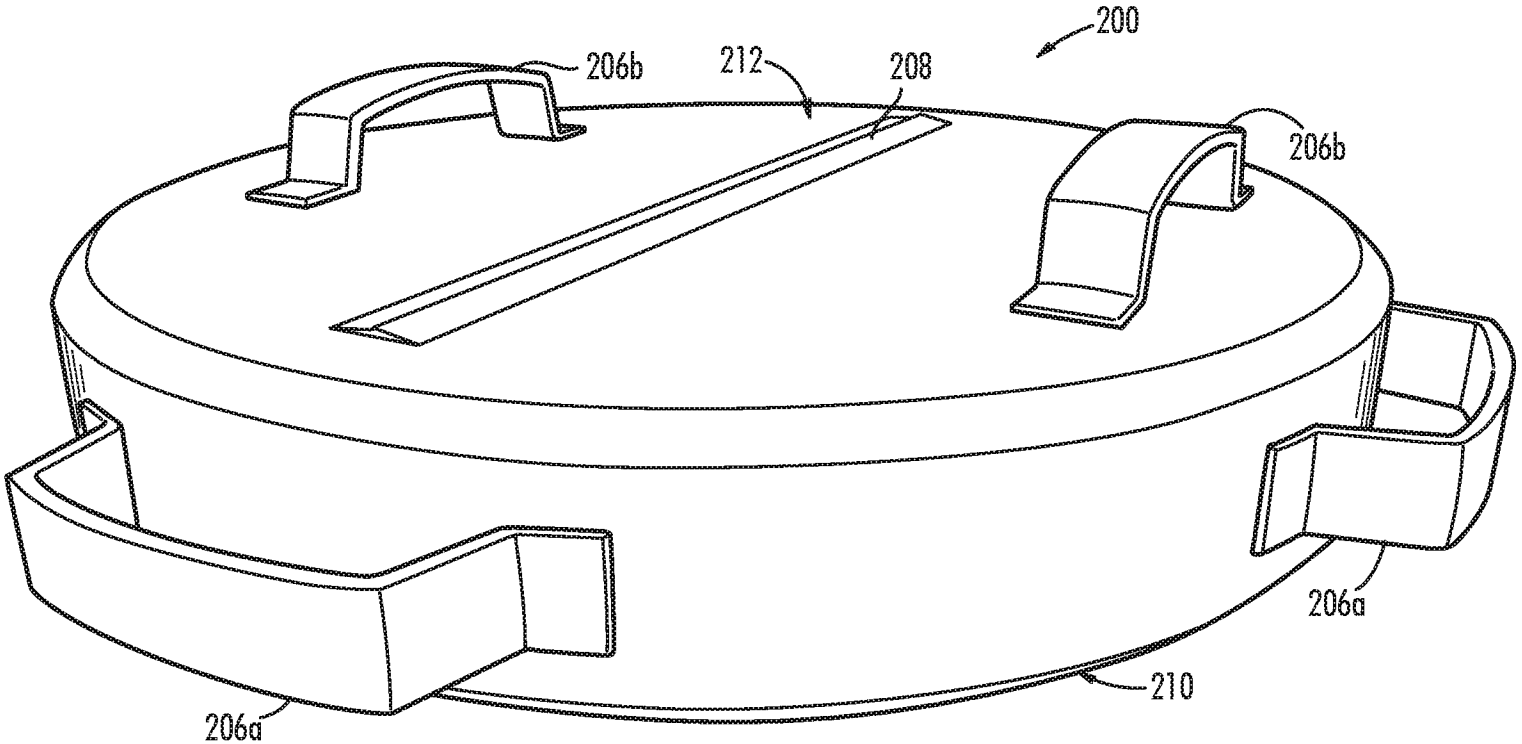
FIG. 3 is a side, perspective view of an exercise bag apparatus.
Figure 4:
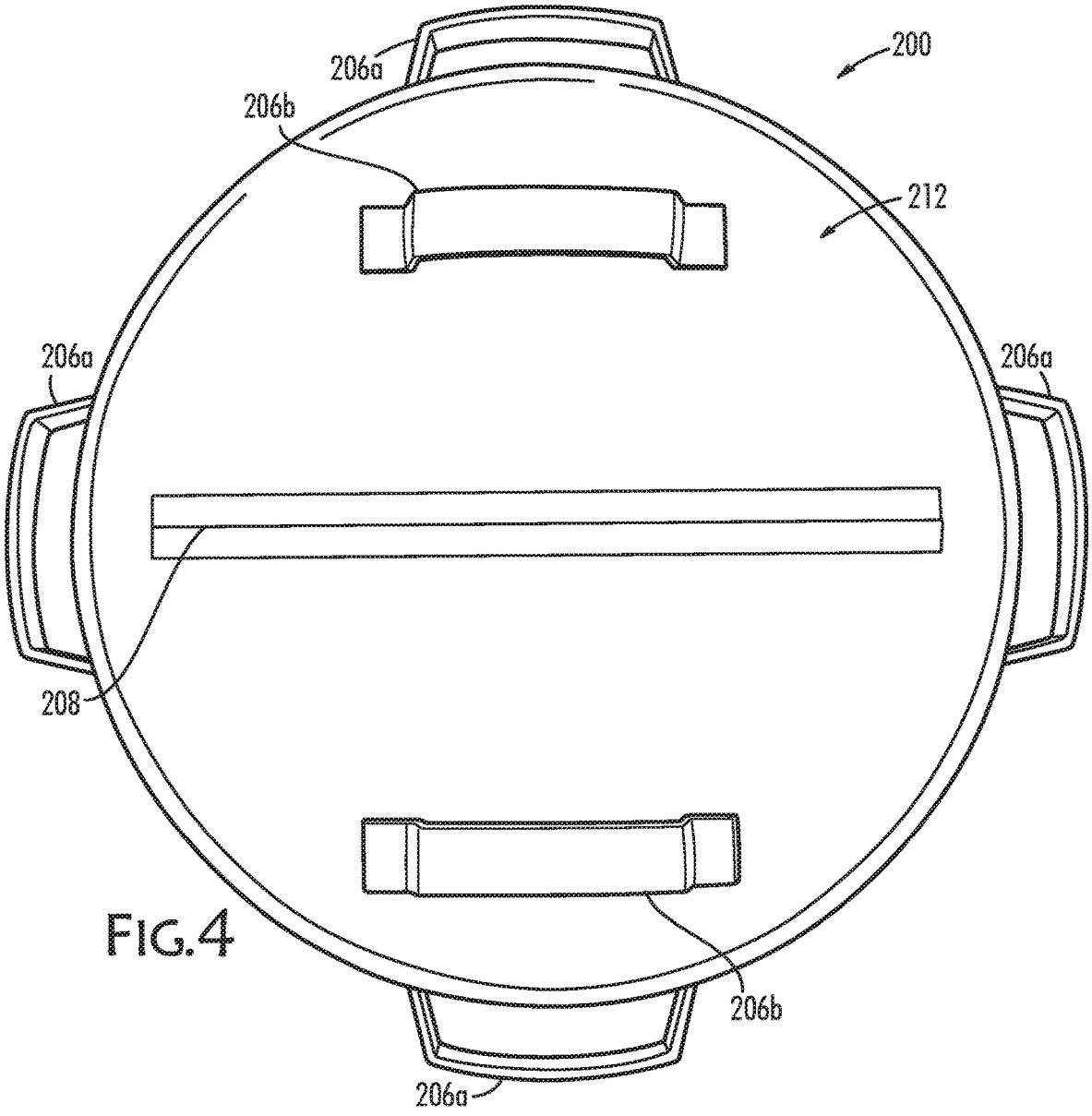
FIG. 4 is a top view of an exercise bag apparatus.
Figure 6:
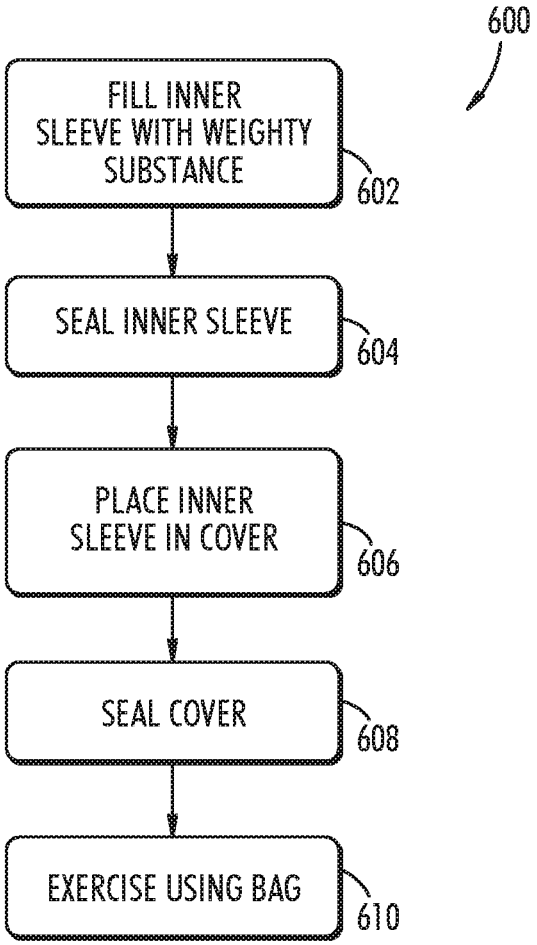
FIG. 6 is a flowchart of a method of using an exercise bag apparatus.

FIG. 2 is a perspective view of an exercise bag apparatus 200, in accordance with an exemplary embodiment of the invention. In the interests of brevity, the exercise bag apparatus 200 is described in conjunction with FIG. 6, a flowchart 600 of a method of using the exercise bag apparatus 200, in accordance with an exemplary embodiment of the invention. It should be understood that generalized exercise bag apparatus 100 could also be used according to the method of FIG. 6. In this particular embodiment, it can be seen that the exercise bag apparatus 200 is provided with four equally spaced handles **206*a* around a vertical surface 210 of the apparatus 200 and two handles 206*b* on a top surface 212 of the apparatus 200. It should be understood that the number and/or configuration of these handles 206*a*, 206*b* (which are analogous to the user interface 106 element of apparatus 100 shown and described with respect to FIG. 1) can be varied from one exercise bag apparatus to another and that the particular configuration of FIG. 2 is by way of example only. The top surface 212 of the apparatus 200 is provided with a re-sealable opening 208 which is used, in an embodiment of the invention, to place (606) an inner sleeve (not shown) reversibly filled (602) and sealed (604) with at least one weighty substance therein. Optionally, the re-sealable opening 208 is reversibly closed (608) with at least one of a zipper, a hook and pile fastener, a button, a clasp, a snap, a slider seal, a double zipper seal, a channel seal, a press seal and the like. In some embodiments, the inner sleeve 104 is filled (602) before placing it into the cover 102. Optionally, the inner sleeve 104 is placed (606) into the cover 102 and then is filled (602). Optionally, the inner sleeve is partially filled (602) before and/or after placing (606) it into the cover 102**.

In an embodiment of the invention, the exercise bag apparatus 200 is pancake shaped to simulate the conventional shape of a weightlifting weight plate such that exercises which are performable with such a weight plate are performable with the exercise bag apparatus 200. In some embodiments, the low-height, wide-based shape provides stability to the apparatus 200 when it is used on a sled or other apparatus that is pulled, pushed, towed or carried by a user. For example, the exercise bag apparatuses 100, 200 described herein could be used with the "Training Sled Apparatus", offered by Sorinex Exercise Equipment, Inc. and described in U.S. Pat. App. Pub. No. US 2017/0326402, the contents of which are incorporated by reference in their entirety herein, where at least one exercise bag apparatus is laid on the platform or placed on the weight post. Optionally, the pancake-shape is practical for stacking multiple apparatuses 200 on top of each other in an efficient and/or stable manner. In some embodiments of the invention, the exercise bag apparatus 200 is approximately 10 inches to 30 inches in diameter. Optionally, the exercise bag apparatus 200 is 18 inches to 24 inches in diameter. In some embodiments of the invention, the exercise bag apparatus 200 is approximately 2 inches to 12 inches in height (where the vertical surface 210 is about this height). Optionally, the exercise bag apparatus 200 is 4 inches to 8 inches in height. Optionally, the cover 102 and/or the inner sleeve 104 have at least one hole therethrough such that a bar or handle could be placed through the exercise bag apparatus 200.

In some embodiments of the invention, a user of the exercise bag apparatus 200 exercises (610) with at least one exercise bag apparatus 200 optionally using at least one user interface 206*a*, 206*b*, by directly grasping/gripping the exercise bag apparatus 200 and/or by picking up the exercise bag apparatus 200. Examples of exercises using the exercise bag apparatus 200 include kettlebell swings, snatches, curls, bench presses, overhead presses, squats, deadlifts, throws, and back extensions. Other applications of the exercise bag apparatus 200 include the user holding the apparatus 200 while performing body movements like twisting and/or rotating the user's trunk. Still further exercises include the farmer's carry (with one, two or more exercise bag apparatuses 200) and dragging exercises (e.g. by attaching the exercise bag apparatus 200 to a harness using a tether of some sort or by putting at least one exercise bag apparatus 200 on a Training Sled Apparatus, such as described above). Optionally, the exercise bag apparatus 200 is used as an anchor point for performing exercise, due to its weight. Optionally, the exercise bag apparatus 200 is used in lieu of weightlifting plates and is attached to something the user holds for performing exercise, like a bar or handle.

Figure 5:
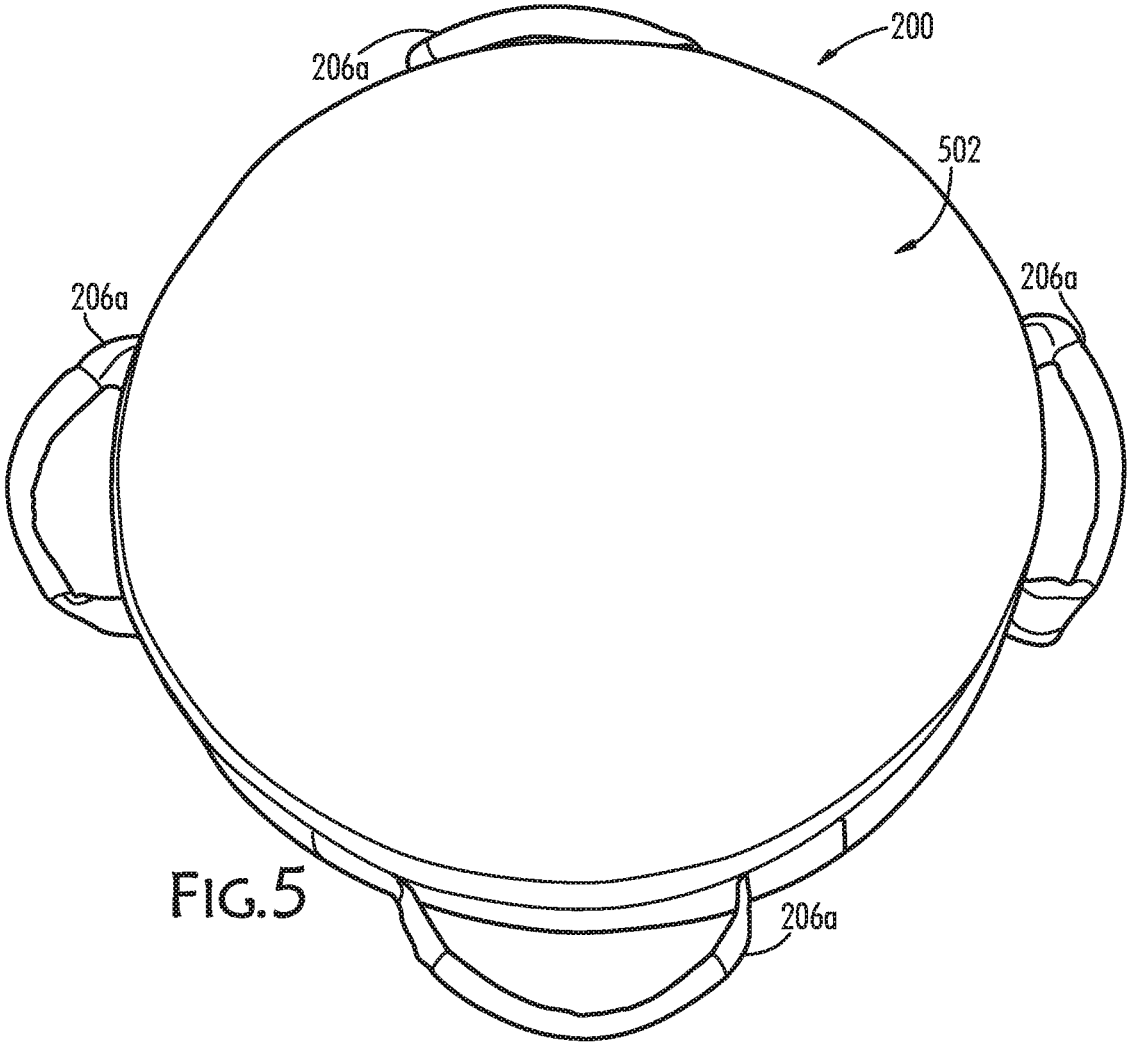
FIG. 5 is a bottom view of an exercise bag apparatus.

FIG. 5 is a view of the bottom surface 502 of an exercise bag apparatus 200, in accordance with an exemplary embodiment of the invention. In FIG. 5, the bottom surface 502 is flat, for example to facilitate sliding of the apparatus 200 during exercise. However, it should be understood that at least one user interface 106 could be added to the bottom surface 502 depending on the intended use of the exercise bag apparatus 200 and/or the preferences of a user.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, "plurality" means two or more.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method of a user exercising with an exercise bag apparatus, the method comprising:

providing the exercise bag apparatus, comprising:

a cover comprising a first re-sealable opening, wherein the cover is shaped like a short vertical cylinder approximately 14 inches to 30 inches in diameter and approximately 2 inches to 12 inches in height, when fully assembled, to simulate a shape of a weightlifting weight plate;

an inner sleeve selectively placed within the cover when the exercise bag apparatus is fully assembled, the inner sleeve comprising a second re-sealable opening and an inner cavity; and at least one user interface disposed on the cover;

filling at least one of the inner sleeve and the cover with a weighty substance;

respectively sealing the at least one of the inner sleeve and the cover to prevent escape of the weighty substance, and to prevent escape of the inner sleeve from the cover if the inner sleeve is placed within the cover; and performing strength training exercises using the exercise bag apparatus, wherein the strength training exercises include kettlebell swings, snatches, curls, bench presses, overhead presses, squats, deadlifts, throws, back extensions, holding the exercise bag apparatus while performing twisting and/or rotating body movements of a trunk of the user, farmer's carries using one or more of the exercise bag apparatus, and dragging exercises.

2. The method of claim 1, further comprising the step of placing the inner sleeve within the cover through the first re-sealable opening prior to filling the inner sleeve.

3. The method of claim 1, further comprising the step of placing the inner sleeve within the cover through the first re-sealable opening after filling the inner sleeve.

4. The method of claim 1, wherein the weighty substance is more than one weighty substances, the method further comprising the step of filling the more than one weighty substances into the at least one of the inner sleeve and the cover in combination so that a space within the cover is more fully utilized.

5. The method of claim 1, wherein the at least one user interface comprises at least one of a handle, a hook, a trap, a band, a groove, a hole and a loop, the method further comprising the step of attaching the at least one user interface of the exercise bag apparatus to another exercise implement, the another exercise implement comprising at least one of a weight bar, an exercise machine, a rack, a harness, a strap, and a handle.

6. The method of claim 1, wherein the step of performing the strength training exercises using the exercise bag apparatus further comprises using the at least one user interface.

7. The method of claim 1, wherein the step of performing the strength training exercises using the exercise bag apparatus further comprises gripping the cover.

* * * * *